United States Patent [19]

Alexander

[11] 4,272,704

[45] Jun. 9, 1981

[54] DC POWER SUPPLY FOR HIGH POWER DISCHARGE DEVICES

[75] Inventor: Jerry L. Alexander, St. Paul Park, Minn.

[73] Assignee: Minnesota Mining and Manufacturing Company, St. Paul, Minn.

[21] Appl. No.: 125,577

[22] Filed: Feb. 28, 1980

[51] Int. Cl.[3] ..... H05B 41/16; H05B 41/18

[52] U.S. Cl. ..... 315/205; 315/199; 315/311; 315/DIG. 7

[58] Field of Search ..... 315/194, 199, 205, 307, 315/311, DIG. 4, DIG. 7

[56] References Cited

U.S. PATENT DOCUMENTS 3,518,486 6/1970 Babcock ..... 315/199

3,962,601 6/1976 Urzesinski ..... 315/241 R

*Primary Examiner*—Alfred E. Smith

*Assistant Examiner*—Thomas P. O'Hare

*Attorney, Agent, or Firm*—Cruzan Alexander; Donald M. Sell; Robert L. Marben

[57] ABSTRACT

A D.C. power supply energized directly from an A.C. source including a voltage doubler circuit supplied with current from the A.C. source via a gate controlled bidirectional switch with the gate circuit for the bidirectional switch connected for control by a disabling switch means. The disabling switch means is controlled by a voltage level sensing circuit that senses the output voltage of the voltage doubler circuit to cause operation of the disabling switch means to disable the gate circuit for the bidirectional switch when a predetermined voltage level is sensed by the sensing circuit.

8 Claims, 4 Drawing Figures

DC POWER SUPPLY FOR HIGH POWER DISCHARGE DEVICES

The present invention relates to a D.C. power supply energized directly from an A.C. source and in particular to such a power supply which is useable for providing the D.C. power necessary for the operation of high power ionizable discharge device such as a xenon or other gas filled lamps.

U.S. Pat. No. 3,962,601 to Stanley Wrzesinski discloses one approach for providing a D.C. power supply useable as the power supply for operation of an ionizable discharge device such as a xenon lamp. The circuit disclosure in the patent uses a transformer to supply power from an A.C. source to the D.C. power supply. A charge level sensing circuit is used to sense the charging of a capacitor to a predetermined charge level. When the predetermined charge level is reached the charge level sensing circuit provides a control signal to operate a switch device that is connected in series with the primary winding of the transformer to eliminate current flow in the primary winding. Such an approach for providing a variable D.C. power supply is undesirable because of the cost, weight and bulk that is introduced by the use of a transformer.

The elimination of the transformer for direct connection to an A.C. source of a D.C. power supply useable for operation of a xenon lamp presents a number of problems for which solutions are not obvious. Reliability should not be sacrificed which dictates the use of solid state components, but such use magnifies the problems that are presented since the use of solid state switch devices such as silicon controlled rectifiers (SCR) or triacs require the need for a reference between the gate electrode of such devices and a main common terminal of the devices. Other requirements are involved when using solid state switching components including the requirement that they be turned on and off with current from the A.C. side of the device with sensing and control signals for such turn on and turn off being derived from the D.C. side of the device. This requires that a common reference for both sides of the switching device be provided. A D.C. voltage level that is in excess of the maximum voltage provided by the A.C. input can be obtained without the use of a step-up transformer by the use of a voltage doubler, but when controlled by solid state switching devices a type of switching device must be selected which provides control of both phases of the A.C. in a like manner.

It is also desirable for a number of reasons that a D.C. power supply be adjustable when used for the operation of a high powered ionizable discharge device such as a xenon lamp, particularly in an apparatus or process where the heat energy output of the xenon lamp is directed toward a heat-sensitive medium or where the light intensity must be adjustable. Aging of the xenon lamp, which affects its energy output, requires that the level of D.C. voltage available for the operation of the xenon lamp be adjustable to correct for such loss in output. Adjustment of the D.C. power level via the use of solid state devices is also desirable since it eliminates problems presented due to variations with the A.C. voltage supply used for operation of the D.C. power supply. In the case of an application where the heat sensitive medium is used in a process utilizing the heat output from a xenon lamp, the response of the medium may vary due to the various environmental factors such as humidity, temperature and age of medium which can be offset to some degree by adjustment of the heat output from the xenon lamp which can be accomplished by use of a variable D.C. power supply for operation of the xenon lamp. In addition, the process may use more than one medium, each requiring a different heat output from the xenon lamp.

SUMMARY OF THE INVENTION

The problems presented when one attempts to eliminate the use of a transformer to obtain a D.C. source supply energized from an A.C. supply for use in operating a gaseous discharge lamp are solved by the present invention which includes a voltage doubler circuit having a capacitor operatively connected to the gaseous discharge lamp and the triggering circuit for the gaseous discharge lamp; a gate controlled bidirectional solid state switch operatively connected to said voltage doubler circuit and the A.C. supply for completing a current path from the A.C. supply to said voltage doubler circuit when said solid state switch is conducting; a voltage controlled gate circuit operatively connected to said solid state switch for causing control of the conduction said solid state switch during each half cycle of the A.C. supply; a voltage level sensing circuit operatively connected to said capacitor; and a bidirectional disabling switch means operatively connected to said voltage controlled gate circuit and said voltage level sensing circuit, said disabling switch means conducting during each half cycle of the A.C. supply when said voltage level sensing circuit is responding to a predetermined voltage level at said capacitor and when conducting preventing said voltage controlled gate circuit from controlling the conduction of said solid state switch.

The disabling switch means can be provided by a second gate controlled bidirectional solid state switch having a trigger signal circuit connected to the A.C. source with a control signal for the trigger signal circuit obtained from the voltage level sensing circuit. The trigger signal circuit can take on a number of forms with a zero voltage switch circuit providing preferred trigger signal circuit. The trigger signal circuit can also be provided by a voltage level comparator circuit.

The gate controlled bidirectional solid state switch provides current flow to the voltage doubler circuit when it is turned on by its voltage controlled gate circuit. Conduction of the gate controlled bidirectional solid state switch is subject to prior conduction of the disabling switch means. Prior conduction of the disabling switch means is provided for each half cycle of the A.C. power when the voltage present at the capacitor at the voltage doubler circuit is at a level sufficient to cause the voltage level sensing circuit to provide a signal to the disabling switch means to cause it to conduct. When the gate controlled bidirectional solid state switch is no longer providing current flow to the voltage doubler circuit, the capacitor of the voltage doubling circuit is at a level determined by the voltage level sensing circuit. The circuit is then conditioned for operation of the triggering circuit for the gaseous discharge lamp. The lamp is ionized causing the capacitor of the voltage doubler circuit to be discharged via the lamp. The disabling switch means then does not receive the signal required to cause it to conduct allowing the gate controlled bidirectional solid state switch to again be turned on by the voltage controlled gate circuit during each half cycle of the A.C. power supply to provide A.C. power to the voltage doubler circuit so the voltage on the capacitor can again reach the level as determined by the voltage level sensing circuit. By making the voltage level sensing circuit adjustable, the level of the voltage that will be provided by the voltage doubler circuit can be varied.

BRIEF DESCRIPTION OF THE DRAWINGS

For a more and complete understanding of the invention, reference should be made to the accompanying drawing wherein like functioning elements of each of the several figures are identified by the same reference characters and wherein.

DETAILED DESCRIPTION OF THE INVENTION

Figure 1:
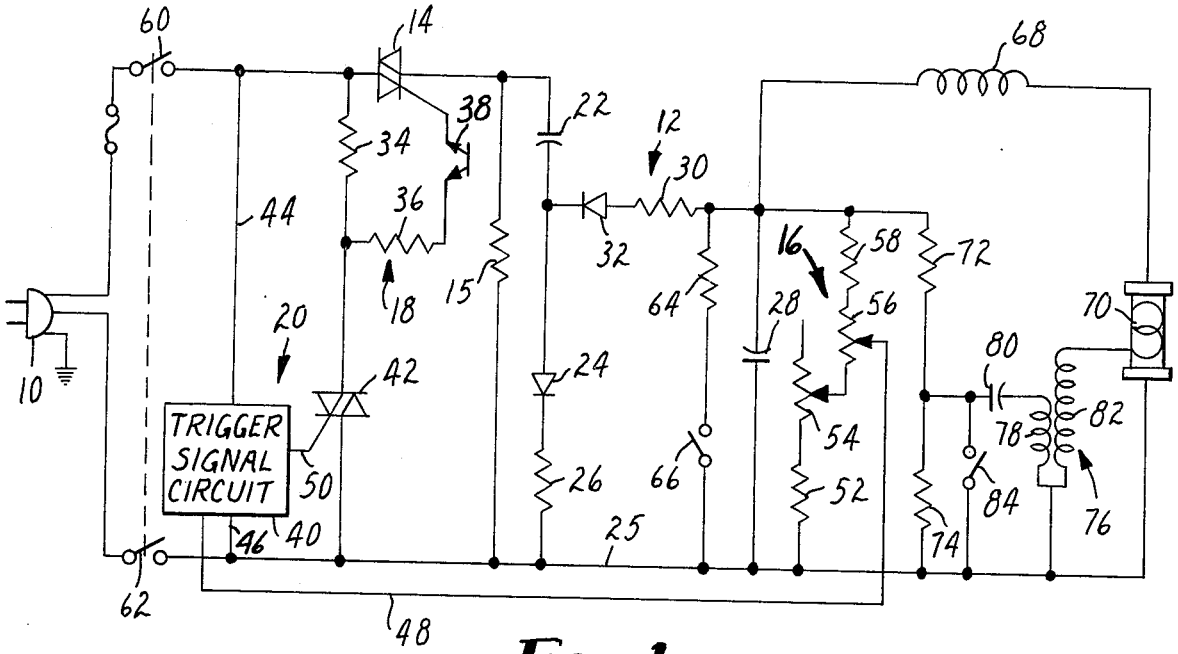
FIG. 1 is an electrical schematic embodying of the invention.

Referring to FIG. 1 of the drawing, an electrical schematic is shown of one embodiment of the invention. The circuitry shown is energized from commercial A.C. power and connects to such supply via the male electrical plug 10. The circuitry includes a voltage doubler circuit indicated generally at 12, a gate controlled bidirectional solid state switch 14 which when conducting connects one side of the A.C. supply to the voltage doubler 12, an adjustable voltage level sensing circuit portion 16 that is operatively connected to the voltage doubler circuit, a voltage controlled gate circuit 18 for the switch 14 and a disabling switch means 20 which is operatively connected to the gate circuit 18 and to the adjustable voltage level sensing circuit 16.

The voltage doubler circuit 12 includes a series circuit portion comprising a capacitor 22, a diode 24 and a resistor 26. The capacitor 22 is connected to one side of the A.C. supply via the solid state switch 14 while the resistor 26 is connected to the other side of the A.C. supply that connects to common conductor 25. This series circuit portion provides a path for current flow during the positive half cycle of the A.C. supply when the solid state switch 14 is conducting. The voltage doubler 12 includes a second series circuit portion comprising a capacitor 28, resistor 30 and diode 32. The diode 32 has its cathode connected to the connection that is common to capacitor 22 and diode 24. The capacitor 28 is connected to the same side of the A.C. supply as resistor 26. A current path is thus provided through the voltage doubler 12 during the negative half cycle in the A.C. supply via the capacitor 28, resistor 30, diode 32, and capacitor 22 when the solid state switch 14 is conducting. The capacitor 28 provides the energy storage capacitor for the voltage doubler. The voltage doubler circuit described is capable of providing a voltage on capacitor 28 that is about 2.8 times the A.C. supply voltage.

The voltage controlled gate circuit 18 is connected between the A.C. supply side of the gate controlled bidirectional solid state switch 14, which can be a triac, and the gate electrode of the switch 14. The gate circuit 18, when allowed to function, turns the switch 14 on during each half cycle of the A.C. supply. The gate circuit 18 includes two series connected resistors 34 and 36 connected in series with a voltage controlled bilateral device 38. The device 38 is of a type that does not conduct until a predetermined voltage level is reached which assures that sufficient holding current will be provided. A diac can be used for the device 38. The resistor 34 is connected to the A.C. supply side of the switch 14, while the diac 38 is connected to the gate electrode of switch 14. Unless the gate circuit 18 is disabled in some fashion, the switch 14 conducts each half cycle of the A.C. supply when the voltage level required for conduction of the diac 38 is reached. It is necessary, however, that the triac 14 also be provided with a holding current circuit, since without a holding current voltage present at the voltage doubler circuit 12 would back bias the switch 14 so it could not conduct. Accordingly, a holding circuit in the form of resistor 15 is connected at one end to the connection common to the triac 14 and capacitor 22 and at the other end to the common conductor 25.

The disabling switch means 20 includes a trigger signal circuit 40 and a gate controlled bidirectional solid state switch 42 which can be a triac. The trigger signal circuit is connected between the A.C. supply via the conductors 44 and 46 and to the adjustable voltage level sensing circuit 16 via the conductor 48. The output of the trigger signal circuit 40 is provided at conductor 50 which is connected to the gate circuit 18 for switch 14 at the connection common to resistors 34 and 36. The other side of the switch 42 is connected to the side of the A.C. supply which is connected to the common conductor 25.

The adjustable voltage level sensing circuit portion 16 is connected across the storage capacitor 28 of the voltage doubler circuit. The adjustable voltage level sensing circuit 16 is basically a potentiometer circuit wherein the resistive portion of the potentiometer is connected across the capacitor 28 with the adjustable connection of the potentiometer connected to the trigger signal circuit 40 via the conductor 48. In order that the desired range of operation can be obtained the adjustable voltage level sensing circuit is obtained from a combination of resistors and potentiometers including a resistive portion 52 which has one end connected to the common conductor 25 with the other end connected to one end of the resistive portion of a potentiometer 54 which in turn has its adjustable connection connected to one end of a potentiometer 56. The other end of potentiometer 56 is connected to the connection common to resistor 30 and capacitor 28 via a resistor 58. The adjustable connection of potentiometer 56 is connected to the trigger signal circuit via the conductor 48. The adjustment made of the potentiometer 54 is a factory type adjustment in that it is set so that the full range of potentiometer 56 can be utilized for the desired degree of adjustability of the voltage sensing circuit. The adjustable voltage level circuit 16 serves to provide a portion of the voltage that appears across the capacitor 28 to the trigger signal circuit 40 dependent on the position of the adjustable connection for potentiometer 56.

A couple of items not discussed in connection with FIG. 1 include switches 60 and 62, one in each of the A.C. supply lines on the circuit side of the power plug 10 and a resistor 64 and a safety interlock switch 66 connected in series across the capacitor 28. The switches 60 and 62 are a part of a power switch provided for controlling the application of A.C. power to the circuitry. The interlock switch 66 is situated to close when it is necessary that the housing (not shown) for the circuit be opened for some reason. Closure of switch 66 connects the resistor 64 across the capacitor 28 to rapidly discharge any voltage that might be present at the capacitor 28.

For purposes of explaining the operation of the circuitry described up to this point, the capacitor 28 is assumed to have no charge on it so the signal supplied from the voltage level sensing circuit 16 to the trigger signal circuit 40 is zero. This being the case, the switch 42 will not conduct at the time the power switch is operated to close switches 60 and 62. The switch 14 is turned on during each half cycle of the A.C. supply by its gate circuit 18 at a voltage level determined by the voltage controlled bilateral device 38 causing the voltage doubler circuit 12 to operate to produce a high voltage on the capacitor 28. As the voltage on capacitor 28 increases, the voltage level signal from the voltage level sensing circuit 16 increases to the point where its setting of the potentiometer 56 provides the necessary signal for operating the trigger signal circuit 40 to cause the switch 42 to be turned on early enough in each cycle of the A.C. supply to disable the gate circuit 18 for switch 14 terminating operation of switch 14 to supply current to the voltage doubler circuit 12. The capacitor 28 is then at the voltage level selected by the setting of the voltage level sensing circuit 16.

The circuitry that has been described can be used to supply D.C. voltage at selected levels for operation of a gaseous discharge device such as a xenon lamp. Circuitry involved in the utilization of the voltage presented across the capacitor 28 for operation of a xenon lamp is well known. One arrangement is shown in FIG. 1 and includes an inductance coil 68 connected in series with a xenon lamp 70 with such series arrangement connected across the capacitor 28. A circuit for triggering the xenon lamp 70 includes series connected resistors 72 and 74 connected across the capacitor 28. The resistors 72 and 74 present a high impedance path so very little leakage current is passed by the two resistors. The resistors 72 and 74 serve as a voltage divider so that the proper voltage can be obtained for operation of a pulse transformer 76. The primary winding 78 of the transformer 76 has one end connected to the common conductor 25 with the other end connected to the connection common to resistors 72 and 74 via a capacitor 80. The secondary winding 82 of the pulse transformer has one end connected to the common conductor 25 with the other end connected to the trigger electrode of xenon lamp 70. A trigger switch 84 is connected between the common conductor 25 and the connection common to the resistors 72 and 74. With this arrangement the capacitor 80 is charged to the level of the voltage that appears across resistor 74. When it is desired that the xenon lamp be energized, the trigger switch 84 is closed by the operator causing the capacitor 80 to be discharged very rapidly via the switch 84. The high discharge current flows through the primary winding 78 of the pulse transformer 76 causing a high voltage to be induced in the secondary winding 82 of the pulse transformer that is sufficient to initiate ionization of the xenon lamp 70. Ionization of the xenon lamp 70 is effective to provide a discharge path for the capacitor 28 via the inductance coil 68 and the xenon lamp 70 to provide for the full ionization of lamp 70. The amount of light and heat energy that is produced due to ionization of the lamp 70 will of course be dependent on the voltage that was available at the capacitor 28. The level of the voltage at capacitor 28 is, as has been mentioned, dependent on the setting of the potentiometer 56 of the voltage level sensing circuit 16.

Figure 2:
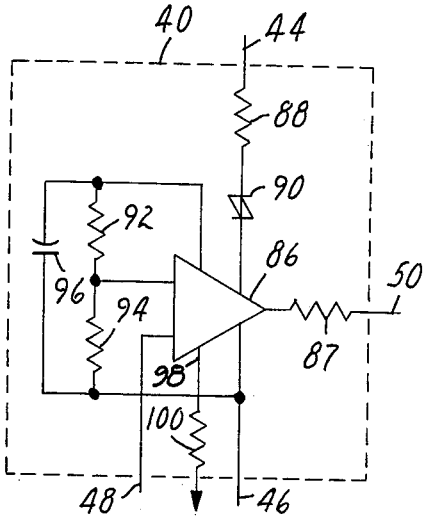
FIG. 2 is one embodiment of a portion of the electrical schematic of FIG. 1.

Up to this point in the description of the invention, the trigger signal circuit 40 has not been discussed in any detail and can take on a number of forms capable of providing the desired function of responding to a voltage level signal from the voltage level sensing circuit 16 to cause the switch 42 to turn on. A preferred form for the trigger signal circuit 40 is shown in FIG. 2 wherein a zero voltage switch 86 is used. A commercially produced zero voltage switch under the type designation MC3370P available from Motorola Semiconductor Products, Inc. can be used. The MC3370P zero voltage switch has a built-in voltage regulator permitting connection directly to an A.C. supply via a proper current limiting resistor and responds to a differential input with provisions for the additon of hysteresis control.

To provide greater tolerance in the selection of a triac device for switch 42, the A.C. supply is connected to the A.C. input of the zero voltage switch 86 via resistor 88 and a voltage controlled bilateral device 90 connected in series with resistor 88. By using a voltage controlled bilateral device 90, a trigger signal from zero voltage switch 86 will turn the switch 42 on at a point in each half cycle of the A.C. supply so the switch 42 remains on for that half cycle of the A.C. supply. It is necessary, however, that the voltage controlled bilateral device be of a type having a switching voltage that is less than the switching voltage for the voltage controlled bilateral device 38 in the gate circuit 18 for switch 14. As has been mentioned, the device 38 can be a diac which is available with switching voltages ranging from about 20 to about 40 volts. The voltage controlled bilateral device 90 can take the form of silicon bilateral switch since such a switch has switching voltages of about 8 volts. The output of the zero voltage switch 86 is connected via a resistor 87 to the input conductor 50 for switch 42.

The trigger signal circuit 40 of FIG. 2 also includes two series connector resistors 92 and 94 which are selected to provide a reference voltage and are connected between the terminals of the zero voltage switch 86 at which the D.C. voltage for the switch 86 appears with the ground terminal of zero switch 86 connected to the conductor 46 which connects to the common conductor 25 of FIG. 1. A smoothing capacitor 96 is connected across the two resistors 92 and 94. The reference input for the zero voltage switch 86 receives the voltage that is present at the connection common to resistors 92 and 94 as a reference voltage. The conductor 48 which connects to the voltage level sensing circuit 16 is connected to the input of the zero voltage switch 86 at which an input signal must be received that is in excess of the reference signal applied to the other input of the zero voltage 86 from resistors 92 and 94 in order to cause the switch 86 to operate and provide a trigger signal on the conductor 50 to switch 42. A transistor (not shown), which is an integral part of the switch 86, has its base connected to the reference input which connects to the resistors 92 and 94. The collector of that transistor is connected to the conductor 98 which can be connected to conductor 46 or can be connected via the resistor 100 to a point intermediate the ends of the resistive portion 52 of the voltage level sensing circuit 16. When connected to the voltage level sensing circuit 16 in this manner, the switch 86 will be provided with hysteresis control. This means that once the voltage capacitor 28 rises to a point sufficient to provide the voltage on conductor 48 needed to switch the zero voltage switch 86 on to provide a triggering signal for the switch 42, the voltage at capacitor 28 can decrease slightly before zero voltage switch 86 will be turned off.

Figure 3:
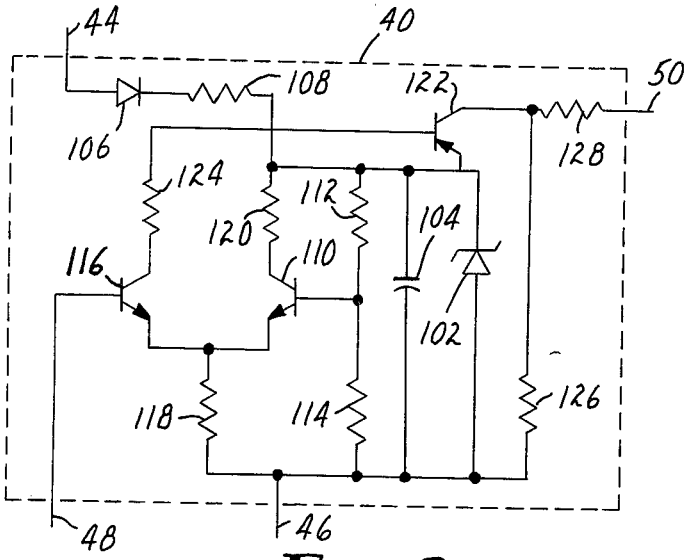
FIG. 3 is a second embodiment of a portion of the electrical schematic of FIG. 1.

Another circuit that is suitable for use as the trigger signal circuit 40 of FIG. 1 is shown in FIG. 3 and is in the form of voltage level comparator circuit. The D.C. voltage that is needed for operation of the circuit is obtained by the circuit which includes a Zener diode 102 connected in parallel with a capacitor 104 with such parallel circuit being connected between the conductor 46 and the conductor 44 via a diode 106 that is connected in series with a resistor 108. The diode 106 has its anode connected to the conductor 44. A portion of the voltage that is presented across the capacitor 104 is applied to the base of an NPN transistor 110 via a voltage divider provided by the series connected resistors 112 and 114 which are connected across the capacitor 104. Another NPN transistor 116 is provided which is connected in a common emitter configuration with transistor 110. The emitters of transistors 110 and 116 are connected via a resistor 118 to the conductor 46. The base of transistor 116 is connected to conductor 48. The collector of transistor 110 is connected via a resistor 120 to the connection common to resistors 108 and 112. A PNP transistor 122 is provided which has its base connected to the collector of transistor 116 via a resistor 124. The emitter of PNP transistor 122 is connected to the connection common to resistors 108 and 112. Its collector is connected to the conductor 46 via a resistor 126 and is also connected to the conductor 50 via a resistor 128.

Assuming the voltage on capacitor 28 is zero when the A.C. power is applied to the circuit of FIG. 1, which will normally be the case, the transistor 116 will be off. Transistor 122 will also be off. Transistor 110, however, will be turned on. When the voltage on the capacitor 28 of the voltage doubler 12 of FIG. 1 increases to a level sensing circuit 16 reaches a level that is in excess of the voltage provided to the base of transistor 110, transistor 116 will be turned on along with transistor 122 and transistor 110 will be off. Conduction of transistor 122 causes a trigger signal to be produced at the conductor 50 which is effective to turn the switch 42 on.

Figure 4:
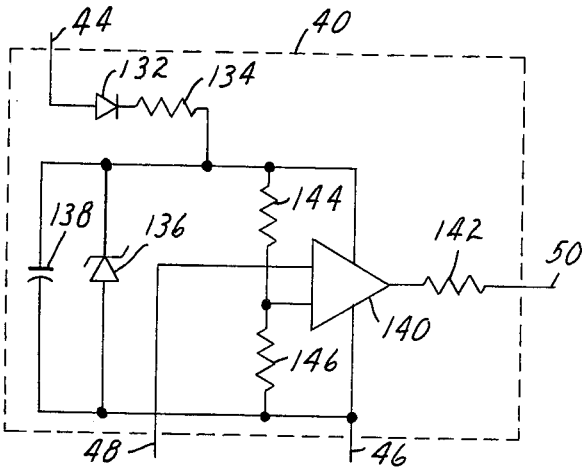
FIG. 4 is a third embodiment of a portion of the electrical schematic of FIG. 1.

Another voltage level comparator circuit that is useable as a trigger signal circuit 40 for FIG. 1, is shown in FIG. 4. The D.C. voltage required for operation of the circuit of FIG. 4 is obtained in a manner that is similar to that described for FIG. 3 in that a series circuit including a diode 132, resistor 134 and a Zener diode 136 is connected between the conductor 44 and conductor 46. The diode 132 has its anode connected to the conductor 44. A smoothing capacitor is 138 is connected in parallel with the Zener diode 136. The voltage appearing across the capacitor 138 is applied to the power input terminals of an operational amplifier 140. The output of the operational amplifier 140 is connected via a resistor 142 to the conductor 50. A voltage divider formed by two series connected resistors 144 and 146 is connected across the Zener diode 136. The other input of the operational amplifier 140 is connected to the conductor 48 which in FIG. 1 is connected to the voltage level sensing circuit 16.

The circuit of FIG. 4 will operate to provide a trigger signal to the switch 42 when the voltage of the capacitor 28 for the voltage doubler circuit 12 increases to a level to cause the voltage level sensing circuit 16 to provide a signal via the conductor 48 to the operational amplifier 140 that is in excess of the reference voltage provided to the operational amplifier 140 via the voltage divider provided by resistors 144 and 146.

While the invention has been described with reference to details of the illustrated embodiments, such details are not intended to limit the scope of the invention as defined in the following claims.

What is claimed is:

1. A D.C. power supply energized from an A.C. supply and connected to a gaseous discharge lamp and a triggering circuit for such lamp for providing D.C. power for operation of such lamp including a voltage doubler circuit having a capacitor operatively connected to the gaseous discharge lamp and the triggering circuit for the gaseous discharge lamp;

a gate controlled bidirectional solid state switch operatively connected to said voltage doubler circuit and the A.C. supply for completing a current path from the A.C. supply to said voltage doubler circuit when said solid state switch is conducting;

a voltage controlled gate circuit operatively connected to said solid state switch for controlling the conduction of said solid state switch during each half cycle of the A.C. supply;

a voltage level sensing circuit operatively connected to said capacitor; and a bidirectional disabling switch means operatively connected to said voltage controlled gate circuit and said voltage level sensing circuit, said disabling switch means conducting during each half cycle of the A.C. supply when said voltage level sensing circuit is responding to a predetermined voltage level at said capacitor and when conducting preventing said voltage controlled gate circuit from causing said solid state switch to conduct.

2. A D.C. power supply according to claim 1 wherein said voltage level sensing circuit is adjustable.

3. A D.C. power supply according to claim 1 wherein said bidirectional disabling switch means includes a trigger signal circuit operatively connected to said voltage level sensing circuit and a gas controlled bidirectional solid state switch operatively connected to said trigger signal circuit and to said voltage controlled gate circuit.

4. A D.C. power supply according to claim 1 wherein said gate controlled bidirectional solid state switch is a triac.

5. A D.C. power supply according to claim 1 wherein said voltage controlled gate circuit includes a resistance means connected at one end to one side of said A.C. supply and a two-terminal voltage controlled device having symmetrical switching voltages connected between the other end of said resistance means and the gate of said gate controlled bidirectional solid state switch.

6. A D.C. power supply according to claim 5 wherein said two-terminal voltage control device is a diac.

7. A D.C. power supply according to claim 1 wherein said bidirectional disabling switch means includes a gate controlled bidirectional solid state switch operatively connected to said voltage controlled gate circuit and a trigger signal circuit operatively connected to said last-mentioned solid state switch and said voltage level sensing circuit, said trigger signal circuit including a zero voltage switch and a voltage controlled bidirectional switch having symmetrical switching voltages connected between said zero voltage switch and one side of the A.C. supply.

8. A D.C. power supply according to claim 1 wherein said voltage controlled gate circuit includes a resistance means connected at one end to one side of the A.C. supply and a two-terminal voltage controlled device having symmetrical switching voltages connected between the other end of said resistance means and said gate controlled bidirectional solid state switch;

said bidirectional disabling switch means including a gate controlled bidirectional solid state switch operatively connected to said one end of said resistance means and a trigger signal circuit operatively connected to said last mentioned solid state switch and said voltage level sensing circuit, said trigger signal circuit including a zero voltage switch and a voltage controlled bidirectional switch having symmetrical switching voltages which are less than the symmetrical switching voltages of said two-terminal voltage controlled device, said voltage controlled bidirectional switch connected between said zero voltage switch and one side of the A.C. supply.

* * * * *